US009660319B1

(12) United States Patent
Xie

(10) Patent No.: US 9,660,319 B1
(45) Date of Patent: May 23, 2017

(54) SIGNAL DISTRIBUTION UTILIZING DIRECTIONAL COUPLERS CONNECTED IN A CHAIN TOPOLOGY

(71) Applicant: Chenggang Xie, Marion, IA (US)

(72) Inventor: Chenggang Xie, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 466 days.

(21) Appl. No.: 14/327,791

(22) Filed: Jul. 10, 2014

(51) Int. Cl.
*H01P 5/18* (2006.01)
*H01Q 21/00* (2006.01)

(52) U.S. Cl.
CPC ..... *H01P 5/18* (2013.01); *H01Q 21/0006* (2013.01)

(58) Field of Classification Search
CPC ..... H01P 5/18; H01Q 21/0006
USPC ..... 343/893; 342/372
See application file for complete search history.

(56) References Cited

U.S. PATENT DOCUMENTS 6,638,603 B1 * 10/2003 Kerins ..... A61L 15/62 428/195.1
2008/0211716 A1 * 9/2008 Haskell ..... H01Q 1/246 342/368
2009/0322610 A1 * 12/2009 Hants ..... H01Q 3/2694 342/372
2011/0248796 A1 * 10/2011 Pozgay ..... G01S 13/4463 333/137

* cited by examiner

*Primary Examiner* — Dameon E Levi
*Assistant Examiner* — David Lotter
(74) *Attorney, Agent, or Firm* — Angel N. Gerdzhikov; Donna P. Suchy; Daniel M. Barbieri

(57) ABSTRACT

The present disclosure is directed to combiners/splitters that reduce packaging and circuit board complexities. More specifically, an apparatus including a chain of directional couplers is used to distribute radio frequency power. The apparatus may also include a set of gain controllers. Each particular gain controller of the set of gain controllers is associated with a particular directional coupler of the chain of directional couplers, and each particular gain controller is configured to adjust a radio frequency power for the associated particular directional coupler.

20 Claims, 6 Drawing Sheets

SIGNAL DISTRIBUTION UTILIZING DIRECTIONAL COUPLERS CONNECTED IN A CHAIN TOPOLOGY

TECHNICAL FIELD

The present disclosure relates generally to electronically scanned arrays, and more particularly to signal distribution for electronically scanned arrays.

BACKGROUND

An electronically scanned array (ESA) is a type of phased array whose transmitter and receiver functions are composed of numerous small solid-state transmit/receive elements. Radio frequency power needs to be distributed to these elements using devices referred to as splitters. Splitters can also be used in reverse to combine radio frequency power from the transmit/receive elements; therefore, they may also be referred to as combiners. The term "combiner/splitter" is generally used to address such devices, as they may be used as combiners or splitters depending on the direction of the signals.

SUMMARY

The present disclosure is directed to an apparatus. The apparatus includes a circuit board, a chain of directional couplers positioned on the circuit board, and a set of gain controllers. Each particular gain controller of the set of gain controllers is associated with a particular directional coupler of the chain of directional couplers, and each particular gain controller is configured to adjust a radio frequency power for the associated particular directional coupler.

Another embodiment of the present disclosure is directed to an antenna. The antenna includes a circuit board, a plurality of antenna elements positioned on the circuit board, and a power splitter configured to distribute radio frequency power to the plurality of antenna elements. The power splitter further includes a chain of directional couplers, wherein each directional coupler of the chain of directional couplers is configured to provide radio frequency power to at least one antenna element of the plurality of antenna elements.

A further embodiment of the present disclosure is also directed to an antenna. The antenna includes a circuit board, a plurality of antenna elements positioned on the circuit board, and a power splitter configured to distribute radio frequency power to the plurality of antenna elements. The power splitter includes a chain of directional couplers, wherein each directional coupler of the chain of directional couplers is configured to provide radio frequency power to at least one antenna element of the plurality of antenna elements. The power splitter further includes a set of gain controllers, wherein each particular gain controller of the set of gain controllers is associated with a particular directional coupler of the chain of directional couplers, and wherein each particular gain controller is configured to adjust an output of the associated particular directional coupler.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to exemplary embodiments of the disclosure, examples of which are illustrated in the accompanying drawings.

Wilkinson power combiner/splitter is a class of power combiner/splitter currently used in various electronically scanned arrays. Wilkinson power combiner/splitter is a multi-layer laminate defining one or more power combiners/splitters of the type originated by Ernest Wilkinson. There are several disadvantages associated with Wilkinson combiner/splitter. For instance, the structure of the Wilkinson combiner/splitter dictates that the number of elements supported by such a combiner/splitter to be limited to $2^N$. Each Wilkinson combiner/splitter also requires $2^N$ resistors, which increases the probability of failure. In addition, four dielectric layers for both transmit and receive combiner/splitter as well as embedded resistive materials are required when using Wilkinson combiners/splitters in an electronically scanned array. Complicated routings also lead to high insertion losses.

The present disclosure is directed to combiners/splitters that reduce packaging and circuit board complexities. More specifically, a chain topology using directional couplers is used to distribute radio frequency power. Directional couplers couple power flowing in one direction, which allows the chain topology to be reversible and a chain of directional couplers can be configured to serve as either a combiner or a splitter.

Figure 1:
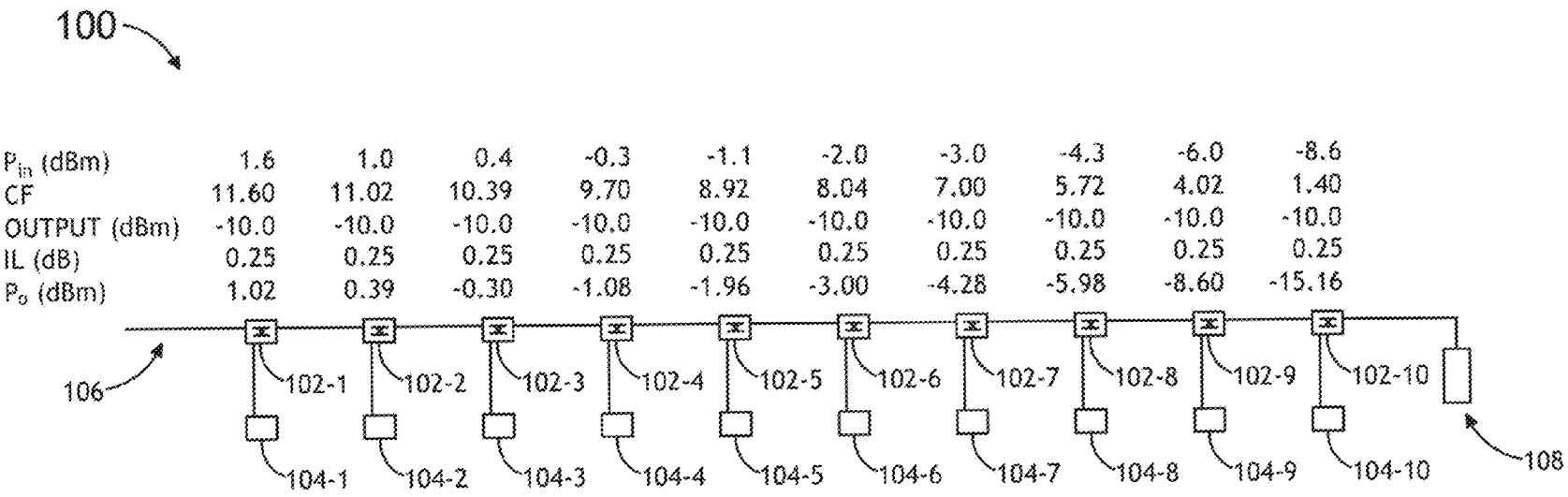
FIG. 1 is an illustration depicting a chain of directional couplers forming a combiner/splitter.

Referring to FIG. 1, an illustration depicting a chain of directional couplers forming a combiner/splitter 100 in accordance with one embodiment of the present disclosure is shown. As shown in FIG. 1, directional couplers 102-1 through 102-10 with different coupling factors are utilized. More specifically, the coupling factors decrease from a starting end 106 of the chain towards a terminating end 108 of the chain. In other words, the coupling factors decrease from the first directional coupler 102-1 towards the last directional coupler 102-10, as the directional couplers are positioned farther away from the input source. This configuration allows the directional couplers 102-1 through 102-10 to deliver substantially identical output powers to their corresponding gain controllers 104, which in turn relaxes the gain control dynamic range requirements on the gain controllers 104.

It is understood that the specific coupling factor values shown in FIG. 1 are merely exemplary. The coupling factor of a particular directional coupler 102 may be determined based on its relative position on a given chain. For instance, if we denote the coupling factor of a particular directional coupler as CF, the insertion loss occurring between that particular directional coupler and the previous directional coupler as IL, the input power as $P_{in}$, the power insertion loss occurring at the particular directional coupler as $P_{il}$, the output power as $P_{out}$, and the remaining power passing through that particular directional coupler and deliverable to a downstream directional coupler as $P_{remaining}$, the following equations can be used to describe their relationships if N directional couplers are used in a chain:

$$P_{in}=P_{il}+P_{out}+P_{remaining}$$

$$P_{out} = P_{in} \cdot N^{-\frac{CF}{N}}$$

$$CF = -N \cdot \log\left(\frac{P_{out}}{P_{in}}\right)$$

$$IL = -N \cdot \log\left(\frac{P_{in} - P_{il}}{P_{in}}\right)$$

$$P_{il} = P_{in} \cdot \left(1 - N^{-\frac{IL}{N}}\right)$$

$$P_{in} = P_{remaining} + P_{in} - P_{in} \cdot N^{-\frac{IL}{N}} + P_{in} \cdot N^{-\frac{CF}{N}}$$

$$P_{remaining} = P_{in} \cdot \left(N^{-\frac{IL}{N}} - N^{-\frac{CF}{N}}\right)$$

It is contemplated that since variables such as the number of directional couplers, the input power, the desired output power are known, the rest of the variables, including the coupling factor of each directional coupler, can be determined based on these equations. It is also contemplated, however, that the equations shown above are exemplary, and the coupling factors may be determined utilizing various other techniques without departing from the spirit and scope of the present disclosure.

It is contemplated that the combiner/splitter 100 as described above may utilize any type of directional coupler. In one embodiment, Lange couplers are used and are implemented as integrated passive devices to further decrease the size and cost of the combiner/splitter. However, other types of directional couplers can also be used without departing from the spirit and scope of the present disclosure.

In addition to reductions in size, cost and board complexity, another advantage provided by the chain topology is that it can support any arbitrary number of elements. This may be accomplished by extending the chain topology to include N-number of directional couplers (i.e., an N-way combiner/splitter). Additionally and/or alternatively, multiple directional coupler chains may be connected together to form a two-dimensional chain topology as depicted in FIG. 2.

Figure 2:
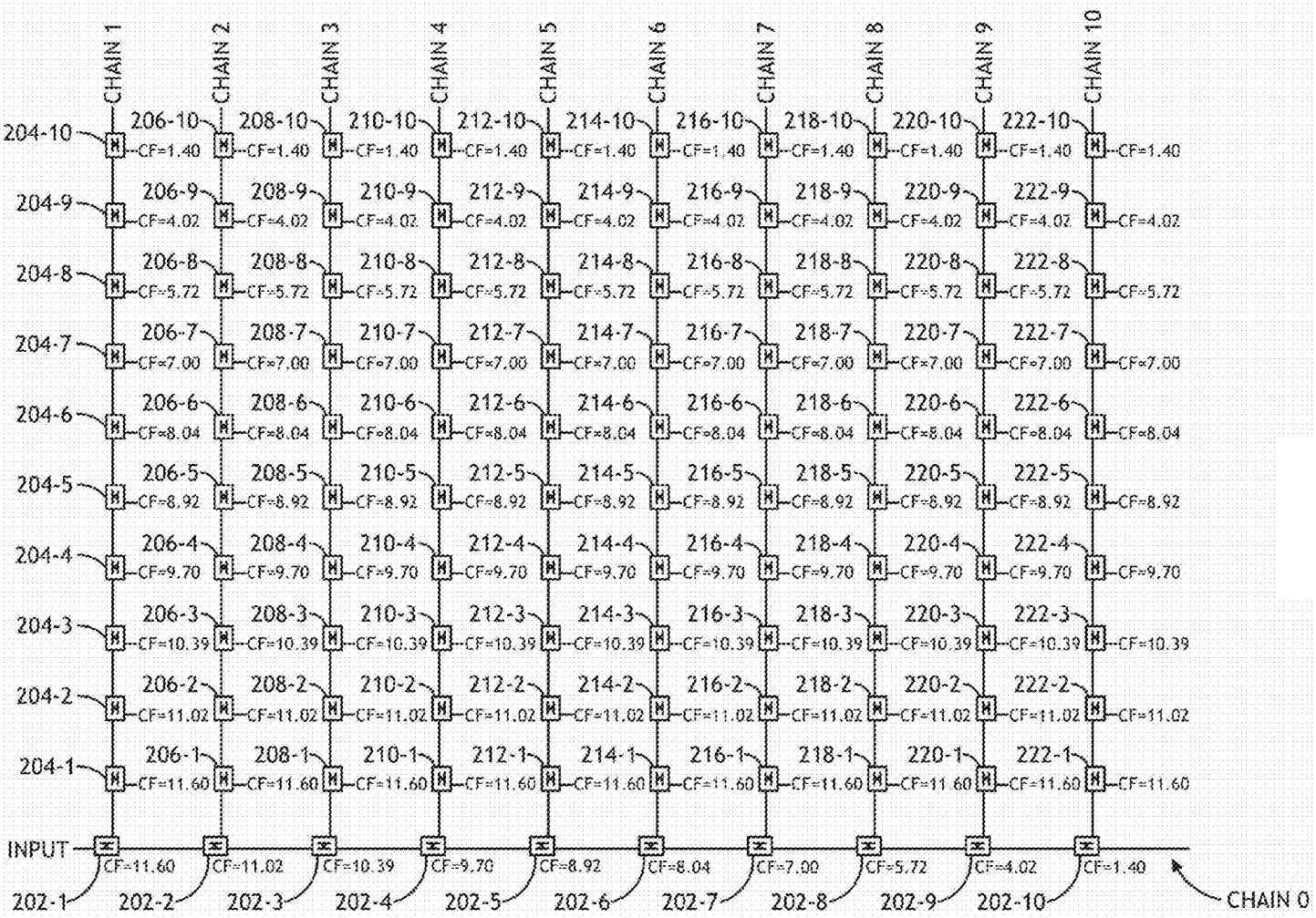
FIG. 2 is an illustration depicting a two-dimensional chain topology combiner/splitter.

FIG. 2 is an illustration depicting a 100-way power combiner/splitter 200 formed using eleven directional coupler chains. One of the chains, denoted as Chain 0, serves as a principal chain that provides input power to the rest of the chains, denoted as Chain 1 through Chain 10. As shown in FIG. 2, directional couplers 202-1 through 202-10 with different coupling factors are utilized in Chain 0 in a similar manner as the couplers depicted in FIG. 1. This configuration allows the directional couplers 202-1 through 202-10 to deliver substantially identical power as input to their corresponding chains Chain 1 through Chain 10.

Each of the chains Chain 1 through Chain 10 also includes multiple directional couplers connected in a manner similar to the chain topology depicted in FIG. 1. More specifically, within each of Chain 1 through Chain 10, the coupling factors of the directional couplers decrease as the directional couplers are positioned farther away from Chain 0. It is noted, however, directional couplers across different chains that are at the same level of distance away from Chain 0 may have the same coupling factor. Relating to the example shown in FIG. 2, coupling factors of directional couplers 204-1 through 204-10 of Chain 1 decrease as the directional couplers are positioned farther away from directional coupler 202-1 of Chain 0. However, it is noted that directional couplers 204-1, 206-1, and 208-1 through 222-1 may have the same coupling factor.

Figure 3:
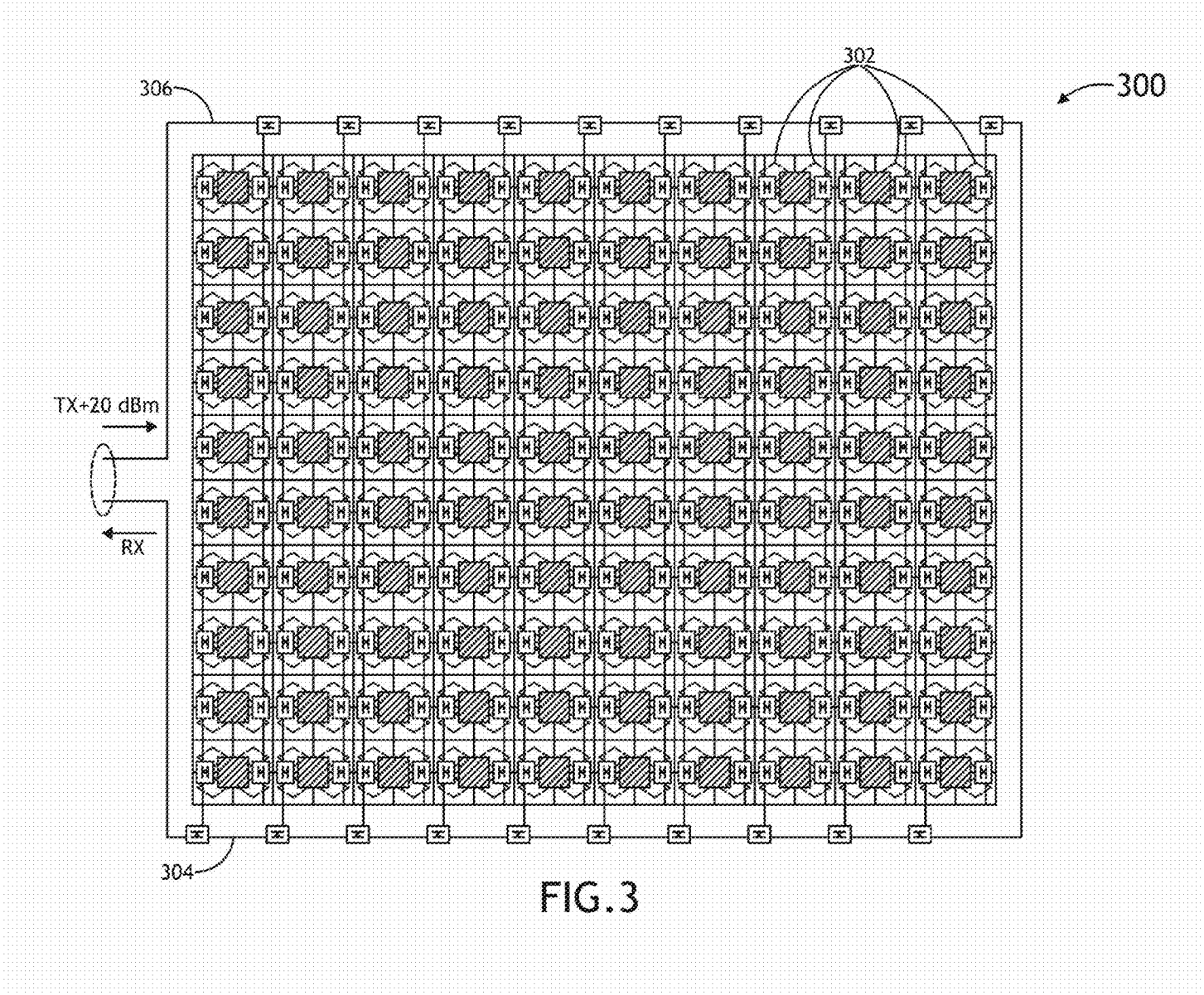
FIG. 3 is an illustration depicting an electronically scanned array utilizing a two-dimensional chain topology combiner and a two-dimensional chain topology splitter.

FIG. 3 is an illustration showing an electronically scanned array 300 having a plurality of transmit/receive elements 302 (may also be referred to as antenna elements) connected utilizing a combiner 304 and a splitter 306 each configured as described in FIG. 2. It is noted that the same hardware components may be utilized to form the combiner 304 and the splitter 306, except for that the signal directions of the directional couplers in the combiner 304 and the splitter 306 are reversed.

Figure 4:
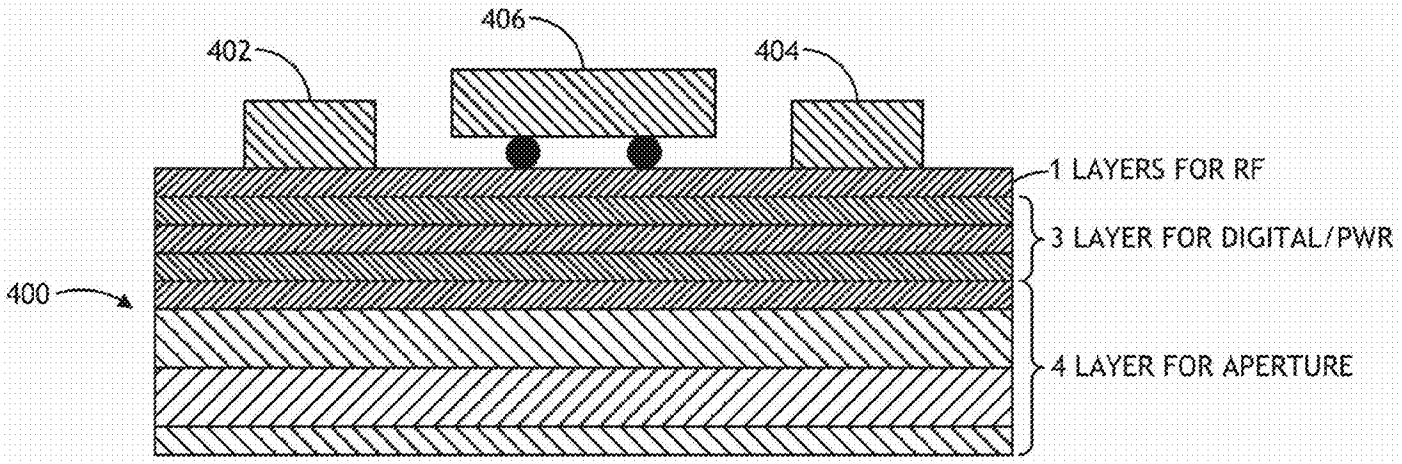
FIG. 4 is an illustration depicting a cross-sectional view of an exemplary antenna panel utilizing chain topology combiner/splitter.

It is contemplated that the combiners/splitters implementing chain topologies in accordance with embodiments of the present disclosure can be placed on the same surface on the circuit board (i.e., utilizing a single layer). FIG. 4 is an illustration depicting a cross-sectional view of an exemplary antenna panel 400. A chain of couplers 402 serving as a combiner for antenna elements 406 and a chain of couplers 404 serving as a splitter for the antenna elements 406 are both positioned on the top surface of the circuit board. It is also contemplated that antenna elements 406 can be packaged as multi-chip modules to further reduce the number of layers implemented.

It is noted that providing the ability to place the entire combiner/splitter topology on a single layer significantly reduces the complexity and the number of dielectric layers needed for an antenna panel. Such a chain-based combiner/splitter topology also provides various other advantages. For instance, any directional coupler can be utilized to form the chain topology, including low cost Lange couplers that can be implemented as integrated passive devices. Since semiconductor materials, such as silicon-germanium and the like, have a wide gain adjustment range, a precise coupling factor of each directional coupler is not important and any discrepancy among elements can be calibrated/mitigated. In addition, the number of elements supported by a chain-based combiner/splitter topology is no longer limited to $2^N$.

It is understood that the examples shown in FIGS. 1 through 3 are merely for illustrative purposes. The number of elements supported by a chain topology in accordance with the present disclosure is not limited to a particular number. It is also noted that the chains in the topologies shown in FIGS. 2 and 3 are not required to have the same number of directional couplers. The number of directional couplers in any given chain in a chain topology may vary without departing from the spirit and scope of the present disclosure.

In addition, it is noted that the two-dimensional chain topologies shown in FIGS. 2 and 3 are depicted in a matrix/rectangular formation merely for purposes of presentation simplicity. The chains are not limited to being straight lines and they may conform to any desired placement specifications without departing from the spirit and scope of the present disclosure.

Figure 5:
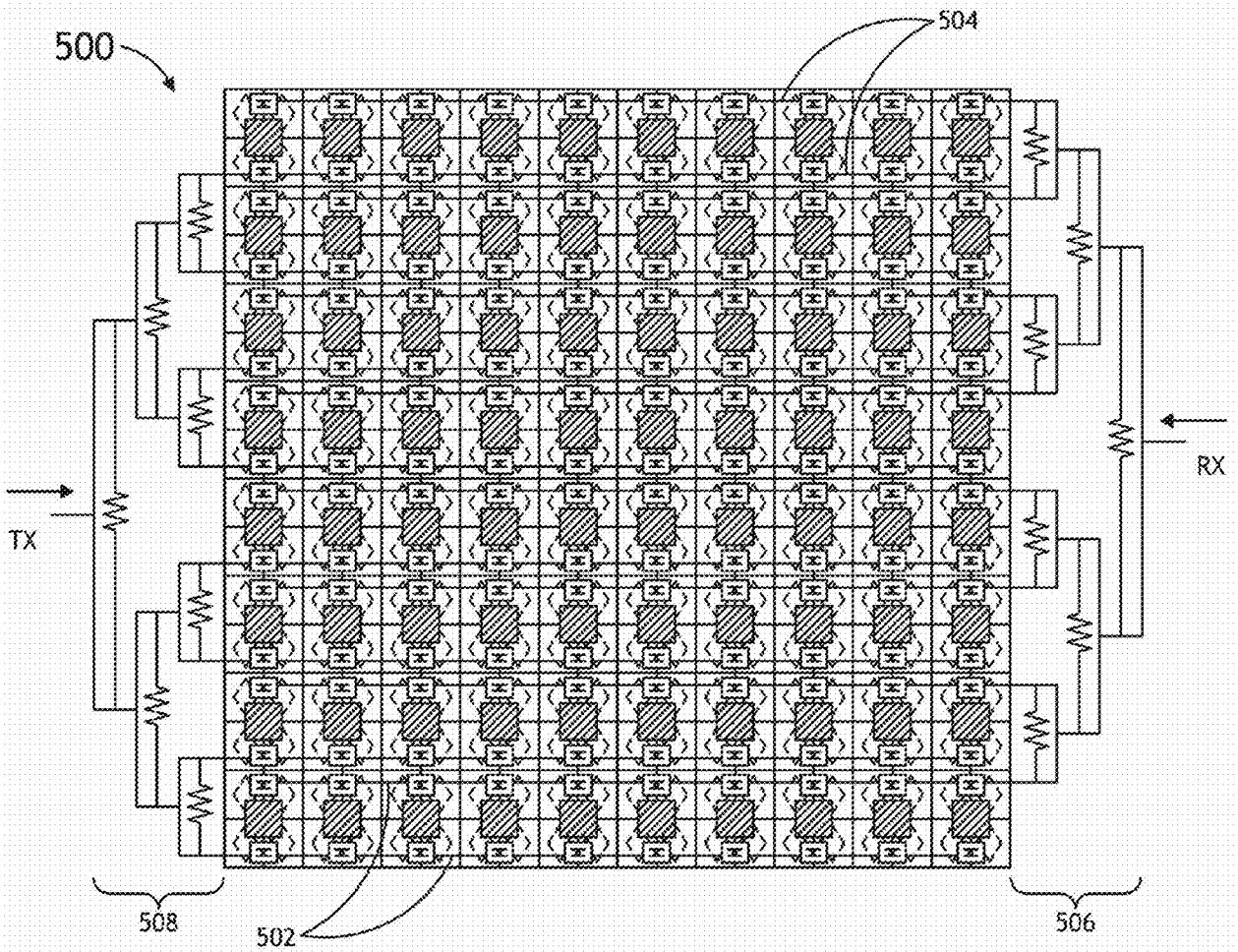
FIG. 5 is an illustration depicting a hybrid topology utilizing chain topology combiners/splitters.

It is contemplated that the chain topologies as described above can also be utilized in conjunction with other types of combiner/splitter topologies. FIG. 5 is an illustration depicting a hybrid topology 500 that includes an 80-way combiner 502 and an 80-way splitter 504 placed on the same surface and connected to an 8-way Wilkinson combiner 506 and an 8-way Wilkinson splitter 508, respectively. This hybrid topology 500 uses the Wilkinson combiner 506 and splitter 508 to serve as manifolds. Connections to the antenna elements are still established through chained directional couplers in order to take the advantages provided by the chain topology as previously described.

Figure 6:
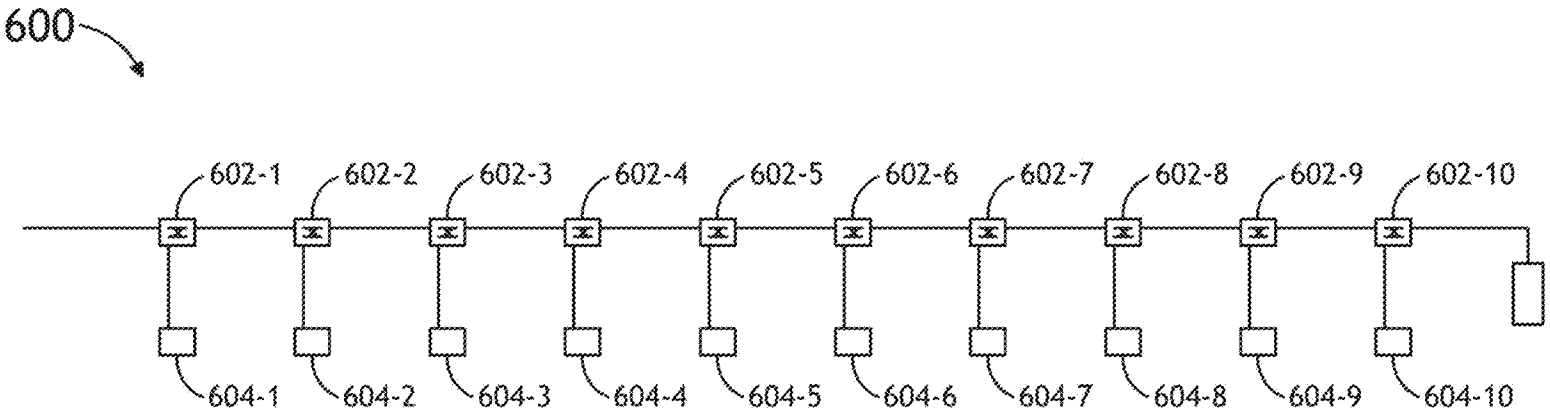
FIG. 6 is an illustration depicting a chain of directional couplers in accordance with embodiments of the present disclosure.

Referring now to FIG. 6, an illustration depicting a chain of directional couplers forming a combiner/splitter 600 in accordance with some embodiments of the present disclosure is shown. In one embodiment, identical directional couplers 602-1 through 602-10 having substantially the same coupling factors are utilized. Instead of configuring the directional couplers 602-1 through 602-10 with different coupling factors, the gain controllers 604-1 through 604-10 are utilized to adjust the output powers.

More specifically, it is noted that the difference in input power between two adjacent directional couplers is equal to the insertion loss (IL) between the directional couplers, and that the maximum difference in an N-coupler chain is equal to N times the insertion loss (N×IL). Given the coupling factor (CF) of the directional couplers 602-1 through 602-10, the amount of gain adjustment to be implemented at each gain controller 604 can be calculated deterministically to provide substantially identical output power throughout the chain 600. For instance, utilizing the notations given above, the $i^{th}$ gain controller 604-*i* associated with the $i^{th}$ directional coupler 602-*i* in the chain 600 can adjust the output power ($P_{out}$) according to the equation: $P_{out}=P_{in}-(i-1)\times IL-CF$, where $1 \leq i \leq N$. The power out of the end of the chain 600 can be recycled or dumped into a load.

It is noted that a combiner/splitter that uses identical directional couplers with variable gain adjustments provides the same advantages as the combiners/splitters that use directional couplers with different coupling factors. Both configurations implement the chain-based combiner/splitter topology in accordance with the present disclosure, and the entire combiner/splitter topology can be placed on a single layer in order to reduce cost, complexity and dielectric layer requirement. In addition, the two-dimensional chain topologies and the hybrid topology described in FIGS. 2 through 5 are also applicable to combiners/splitters that use identical directional couplers with variable gain adjustments, and as previously described, the number of elements supported by the chain-based combiner/splitter topology is flexible and is not limited to $2^N$.

It is also contemplated that the coupling factors of the directional couplers used in a chain may not to be either all unique or all identical. In some embodiments, directional couplers with substantially identical coupling factors can be arranged as a group, and number of different groups of directional couplers can be arranged to form the chain. For illustrative purposes, referring again to FIG. 6 and the table below:

| Coupler | 602-1 | 602-2 | 602-3 | 602-4 | 602-5 | 602-6 | 602-7 | 602-8 | 602-9 | 602-10 |
|---|---|---|---|---|---|---|---|---|---|---|
| Pin (dBM) | 13.2 | 12.7 | 12.2 | 11.7 | 11.3 | 10.6 | 10.0 | 9.4 | 8.5 | 7.6 |
| CF | 13.00 | 13.00 | 13.00 | 13.00 | 11.00 | 11.00 | 11.00 | 9.00 | 9.00 | 9.00 |
| IL (dB) | 0.25 | 0.25 | 0.25 | 0.25 | 0.25 | 0.25 | 0.25 | 0.25 | 0.25 | 0.25 |
| Pout (dBm) | 0.2 | −0.3 | −0.8 | −1.3 | 0.3 | −0.4 | −1.0 | 0.4 | −0.5 | −1.4 |

As depicted in this example, three different groups of directional couplers are used for form this chain. More specifically, the first group of directional couplers 602-1 through 602-4 have the same first coupling factor, the second group of directional couplers 602-5 through 602-7 have the same second coupling factor that is smaller than the first coupling factor, and the third group of directional couplers 602-8 through 602-10 have the same third coupling factor that is smaller than the second coupling factor. The three groups are arranged in this manner so that while the coupling factors of the directional couplers within each group are substantially the same, the coupling factors at the group level are arranged in a descending order as the groups are placed farther away from the input source.

It is noted that this configuration partially relaxes the gain control dynamic range properties on the gain controllers, as the gain control dynamic range only covers the variations within a given group instead of the entire chain. This configuration also reduces the number of different directional couplers implemented. That is, instead of using ten different directional couplers as shown in FIG. 1, only three different directional couplers are implemented in some embodiments. It is also noted that the output power to be delivered to each antenna element supported by the chain may be slightly different, but the power can be compensated by a variable gain controller/amplifier as previously described.

It is understood that the examples shown above are merely exemplary. The number of groups in a chain topology and the number of directional couplers in each group may vary without departing from the spirit and scope of the present disclosure.

It is also understood that while electronically scanned arrays and antennas utilizing electronically scanned arrays are referenced in the examples above, the power combiners and splitters in accordance with the present disclosure are not limited to electronically scanned array applications. It is contemplated that the power combiners and splitters in accordance with the present disclosure can be utilized in various types of printed circuit boards for various types of antennas and other devices without departing from the spirit and scope of the present disclosure.

It is understood that the present disclosure is not limited to any underlying implementing technology. The present disclosure may be implemented utilizing any combination of software and hardware technology. The present disclosure may be implemented using a variety of technologies without departing from the scope and spirit of the disclosure or without sacrificing all of its material advantages.

It is understood that the specific order or hierarchy of steps in the processes disclosed is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

It is believed that the present disclosure and many of its attendant advantages will be understood by the foregoing description, and it will be apparent that various changes may be made in the form, construction, and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. An apparatus, comprising:

a circuit board;

a chain of directional couplers positioned on the circuit board, a first directional coupler of the chain of directional couplers receiving radio frequency power and delivering radio frequency power directly to a second directional coupler, the radio frequency power respectively received or delivered being associated with a position of a respective directional coupler in the chain; and a set of gain controllers, each particular gain controller of the set of gain controllers being associated with a particular directional coupler of the chain of directional couplers, wherein each particular gain controller is configured to adjust the radio frequency power input or output for the associated particular directional coupler.

2. The apparatus of claim 1, wherein each directional coupler of the chain of directional couplers has a unique coupling factor with respect to each other directional coupler of the chain of directional couplers, and wherein the coupling factors of the chain of directional couplers decreases from the first directional coupler of the chain towards a last directional coupler of the chain.

3. The apparatus of claim 1, wherein the position is a relative position, and wherein each directional coupler of the chain of directional couplers has a substantially identical coupling factor with respect to each other directional coupler of the chain of directional couplers, and wherein each particular gain controller is configured to adjust the radio frequency power input or output for the associated particular directional coupler based on the relative position of the particular directional coupler in the chain.

4. The apparatus of claim 1, wherein the chain of directional couplers comprises at least a first group of directional couplers and a second group of directional couplers, wherein the directional couplers of the first group have a substantially identical first coupling factor and the directional couplers of the second group have a substantially identical second coupling factor, and wherein the first coupling factor is different from the second coupling factor.

5. The apparatus of claim 1, wherein the chain of directional couplers is positioned on a single surface of the circuit board.

6. The apparatus of claim 1, wherein the chain of directional couplers is utilized as at least one of: a radio frequency power combiner and a radio frequency power splitter.

7. The apparatus of claim 1, wherein the chain of directional couplers is utilized as at least one of: a radio frequency power combiner and a radio frequency power splitter for an electronically scanned array.

8. An antenna, comprising:

a circuit board;

a plurality of antenna elements positioned on the circuit board; and a power splitter configured to distribute radio frequency power to the plurality of antenna elements, the power splitter further comprising:

a chain of directional couplers, each directional coupler of the chain of directional couplers configured to provide radio frequency power to at least one antenna element of the plurality of antenna elements, wherein a first directional coupler of the chain of directional couplers receives radio frequency power and delivers the radio frequency power directly to a second directional coupler, the radio frequency power respectively received or delivered being associated with a position of a respective directional coupler in the chain.

9. The antenna of claim 8, wherein each directional coupler of the chain of directional couplers has a unique coupling factor with respect to each other directional coupler of the chain of directional couplers, and wherein the coupling factors of the chain of directional couplers decreases from the first directional coupler of the chain towards a last directional coupler of the chain.

10. The antenna of claim 8, wherein the position is a relative position, and wherein each directional coupler of the chain of directional couplers has a substantially identical coupling factor with respect to each other directional coupler of the chain of directional couplers, and wherein the radio frequency power of each particular directional coupler is adjusted based on the relative position of the particular directional coupler in the chain.

11. The antenna of claim 8, wherein the chain of directional couplers comprises at least a first group of directional couplers and a second group of directional couplers, wherein the directional couplers of the first group have a substantially identical first coupling factor and the directional couplers of the second group have a substantially identical second coupling factor, and wherein the first coupling factor is different from the second coupling factor.

12. The antenna of claim 8, wherein the chain of directional couplers is a first chain of directional couplers, and wherein the power splitter further comprises:

a second chain of directional couplers positioned on a same surface of the circuit board as the first chain of directional couplers, each directional coupler of the second chain of directional couplers configured to provide radio frequency power to at least one antenna element of the plurality of antenna elements.

13. The antenna of claim 12, wherein the power splitter further comprises:

a third chain of directional couplers positioned on the same surface of the circuit board as the first chain of directional couplers and the second chain of directional couplers, wherein one directional coupler of the third chain of directional couplers is configured to provide radio frequency power to a first directional coupler of the first chain of directional couplers, and another directional coupler of the third chain of directional couplers is configured to provide radio frequency power to a first directional coupler of the second chain of directional couplers.

14. The antenna of claim 12, wherein the first directional coupler comprises a first directional coupler of the first chain of directional couplers, and wherein the power splitter further comprises:

a multi-layer laminate power splitter configured to provide radio frequency power to the first directional coupler of the first chain of directional couplers and a first directional coupler of the second chain of directional couplers.

15. The antenna of claim 8, further comprising:

a power combiner configured to combine radio frequency power from the plurality of antenna elements, the power combiner further comprising:

a chain of directional couplers, each directional coupler of the chain of directional couplers configured to receive radio frequency power from at least one antenna element of the plurality of antenna elements.

16. The antenna of claim 15, wherein the power splitter and the power combiner are positioned on a same surface of the circuit board.

17. An antenna, comprising:

a circuit board;

a plurality of antenna elements positioned on the circuit board; and a power splitter configured to distribute radio frequency power to the plurality of antenna elements, the power splitter further comprising:

a chain of directional couplers, each directional coupler of the chain of directional couplers configured to provide radio frequency power to at least one antenna element of the plurality of antenna elements, and a first directional coupler of the chain receiving radio frequency power and delivering radio frequency power directly to a second directional coupler, the radio frequency power respectively received or delivered being associated with a position of a respective directional coupler in the chain; and a set of gain controllers, each particular gain controller of the set of gain controllers being associated with a particular directional coupler of the chain of directional couplers, wherein each particular gain controller is configured to adjust an input or an output of the associated particular directional coupler.

18. The antenna of claim 17, wherein each directional coupler of the chain of directional couplers has a unique coupling factor with respect to each other directional coupler of the chain of directional couplers, and wherein the coupling factors of the chain of directional couplers decreases from the first directional coupler of the chain towards a last directional coupler of the chain.

19. The antenna of claim 17, wherein the position is a relative position, and wherein each directional coupler of the chain of directional couplers has a substantially identical coupling factor with respect to each other directional coupler of the chain of directional couplers, and wherein each particular gain controller is configured to adjust the input or the output of the associated particular directional coupler based on the relative position of the particular directional coupler in the chain.

20. The antenna of claim 17, wherein the chain of directional couplers comprises at least a first group of directional couplers and a second group of directional couplers, wherein the directional couplers of the first group have a substantially identical first coupling factor and the directional couplers of the second group have a substantially identical second coupling factor, and wherein the first coupling factor is different from the second coupling factor.

* * * * *